US010805716B2

(12) United States Patent
Zheng

(10) Patent No.: US 10,805,716 B2
(45) Date of Patent: Oct. 13, 2020

(54) PACKAGE STRUCTURE OF MEMS MICROPHONE

(71) Applicant: GOERTEK.INC, Weifang, Shandong (CN)

(72) Inventor: Guoguang Zheng, Weifang (CN)

(73) Assignee: GOERTEK.INC, Weifang, Shandong (CN)

( * ) Notice: Subject to any disclaimer, the term of this patent is extended or adjusted under 35 U.S.C. 154(b) by 0 days.

(21) Appl. No.: 15/554,623

(22) PCT Filed: Dec. 10, 2015

(86) PCT No.: PCT/CN2015/096913
§ 371 (c)(1),
(2) Date: Aug. 30, 2017

(87) PCT Pub. No.: WO2016/176994
PCT Pub. Date: Nov. 10, 2016

(65) Prior Publication Data

US 2018/0054669 A1 Feb. 22, 2018

(30) Foreign Application Priority Data

May 6, 2015 (CN) ..... 2015 1 0227099

(51) Int. Cl.
*H04R 1/28* (2006.01)
*H04R 19/04* (2006.01)
(Continued)

(52) U.S. Cl.
CPC ..... *H04R 1/2807* (2013.01); *H04R 1/222* (2013.01); *H04R 1/2876* (2013.01); *H04R 19/04* (2013.01);
(Continued)

(58) Field of Classification Search
CPC .. H04R 1/2876; H04R 1/2869; H04R 1/2846; H04R 1/2823; H04R 19/005;
(Continued)

(56) References Cited

U.S. PATENT DOCUMENTS 6,781,231 B2 * 8/2004 Minervini ..... B81B 7/0064
9,351,062 B2 * 5/2016 Inoda ..... H04R 19/04
(Continued)

*Primary Examiner* — Sunita Joshi
(74) *Attorney, Agent, or Firm* — Ladas & Parry LLP

(57) ABSTRACT

The present invention discloses a package structure of a MEMS microphone. The package structure comprises a package substrate and a package shell, wherein the package shell is provided on the package substrate and forms a closed cavity with the package substrate. In the package structure provided by the present invention, the sound-absorbing layer is arranged on the inner wall of the Helmholtz resonant cavity. The sound-absorbing layer has a certain absorption capacity to high-frequency sound waves, but has a very low absorption to low-frequency sound waves, so it may be equivalent to a "low-pass filter". Through the absorption of the high-frequency sound waves, a high-frequency amplitude value of sound waves can be suppressed, reducing high-frequency response of the Helmholtz resonant cavity. That is, a high-frequency cut-off frequency of the sound waves is improved, widening operation bandwidth of the MEMS microphone.

18 Claims, 2 Drawing Sheets

(51) Int. Cl.
*H04R 1/22* (2006.01)
*H04R 19/00* (2006.01)

(52) U.S. Cl.
CPC ..... *H04R 19/005* (2013.01); *H04R 2201/003* (2013.01)

(58) Field of Classification Search
CPC ..... H04R 19/004; B81C 1/00238; B81C 1/00309; B81C 1/0026; B81C 1/0023; B81B 2201/0257
See application file for complete search history.

(56) References Cited

U.S. PATENT DOCUMENTS

2009/0001553 A1* 1/2009 Pahl ..... B81B 7/0064 257/704
2010/0109103 A1* 5/2010 Tsao ..... B81B 7/0064 257/418
2013/0059409 A1* 3/2013 Wang ..... H04R 19/005 438/51
2015/0181346 A1* 6/2015 Jingming ..... H04R 1/02 381/114

* cited by examiner

PACKAGE STRUCTURE OF MEMS MICROPHONE

CROSS REFERENCE TO RELATED APPLICATION

This application is a national stage application, filed under 35 U.S.C. § 371, of International Application No. PCT/CN2015/096913, filed on Dec. 10, 2015, which claims priorities to Chinese Application No. 201510227099.3 filed on May 6, 2015, the content of which is hereby incorporated by reference in its entirety.

FIELD OF THE INVENTION

The present invention relates to the field of acoustic-electric conversion, and relates to a microphone, and more particularly, to a package structure of a MEMS (Micro-electromechanical System) microphone.

BACKGROUND OF THE INVENTION

MEMS (Micro-electromechanical System) microphones are manufactured based on the MEMS technology. In a MEMS microphone, a vibrating diaphragm and a back plate are important components which constitute a capacitor and are integrated on a silicon wafer, so as to realize acoustic-electric conversion.

A package structure of the MEMS microphone is shown in FIG. 1. A MEMS chip 3 and an ASIC (Application Specific Integrated Circuit) chip 2 are attached on a package substrate 1, and connected via wire bonding, and then a package shell 4 with a sound hole 5 is attached on the package substrate 1 to form a front cavity of the MEMS microphone. The front cavity of the MEMS microphone forms a Helmholtz resonant cavity. Incident sound waves enter the front cavity of the MEMS microphone from the sound hole 5. With the increase of an incident frequency, sound wave intensity increases. When a sound wave frequency is the same as a resonant frequency of the Helmholtz resonant cavity, a resonance phenomenon appears, and the intensity of sound waves in the front cavity reaches the highest. FIG. 2 shows a frequency response curve of the MEMS microphone. Along with the increase of the frequency, sensitivity of the MEMS microphone increases. When a resonant frequency of the front cavity appears, the sensitivity increases sharply. However, an operation bandwidth of the MEMS microphone is limited due to sharp increase of a high-frequency output amplitude value.

Therefore, there is a demand in the art that a new solution for a package structure of a MEMS microphone shall be proposed to address at least one of the problems in the prior art.

SUMMARY OF THE INVENTION

An object of the present invention is to provide a new technical solution of a package structure of a MEMS microphone.

According to a first aspect of the present invention, there is provided a package structure of a MEMS microphone. The package structure comprises a package substrate and a package shell, wherein the package shell is provided on the package substrate and forms a closed cavity with the package substrate. The package structure further comprises a sound hole allowing sound to flow into the closed cavity. The package shell, the package substrate and the sound hole together constitute a Helmholtz resonant cavity, in which a MEMS chip and an ASIC chip are provided; and at least part of an inner wall of the Helmholtz resonant cavity is provided with a sound-absorbing layer.

Alternatively or optionally, the sound-absorbing layer is provided on the inner walks) of the top and/or the side of the package shell.

Alternatively or optionally, the sound-absorbing layer is provided on the inner wall of the package substrate.

Alternatively or optionally, the sound-absorbing layer is of a mesh structure.

Alternatively or optionally, the sound-absorbing layer is provided in a coating manner.

Alternatively or optionally, the sound-absorbing layer is polyimide.

Alternatively or optionally, a sound-permeable layer covering the sound hole is further provided at the sound hole of the package shell.

Alternatively or optionally, the sound-absorbing layer is further provided on the surface of the ASIC chip.

Alternatively or optionally, the MEMS chip and the ASIC chip are provided on the package substrate; and the sound hole is provided on the package shell.

Alternatively or optionally, the package shell is in the form of a flat plate; and the package structure further comprises a side wall portion for supporting the package shell on the package substrate.

In the package structure provided by the present invention, the sound-absorbing layer is provided on the inner wall of the Helmholtz resonant cavity. The sound-absorbing layer has a certain absorption capacity to high-frequency sound waves, but has a very low absorption to low-frequency sound waves, so it may be equivalent to a "low-pass filter". Through the absorption of the high-frequency sound waves, a high-frequency amplitude value of sound waves can be suppressed, reducing high-frequency response of the Helmholtz resonant cavity. That is, a high-frequency cut-off frequency of the sound waves is improved, widening operation bandwidth of the MEMS microphone.

The inventor of the present invention has found that in the prior art, with the increase of an incident frequency; sound wave intensity increases. When a frequency of incident sound waves is the same as a resonant frequency of the Helmholtz resonant cavity, a resonance phenomenon appears, and the intensity of sound waves in the front cavity reaches the highest. However, the operation bandwidth of the MEMS microphone is limited due to sharp increase of the high-frequency output amplitude value. Therefore, the technical task to be achieved or the technical problem to be solved by the present invention is unintentional or unanticipated for those skilled in the art, and thus the present invention refers to a novel technical solution.

Further features of the present invention and advantages thereof will become apparent from the following, detailed description of exemplary embodiments according to the present invention with reference to the attached drawings.

BRIEF DESCRIPTION OF THE DRAWINGS

The accompanying drawings, which are incorporated in and constitute a part of the specification, illustrate embodiments of the invention and, together with the description thereof, serve to explain the principles of the invention.

DETAILED DESCRIPTION OF THE EMBODIMENTS

Figure 1:
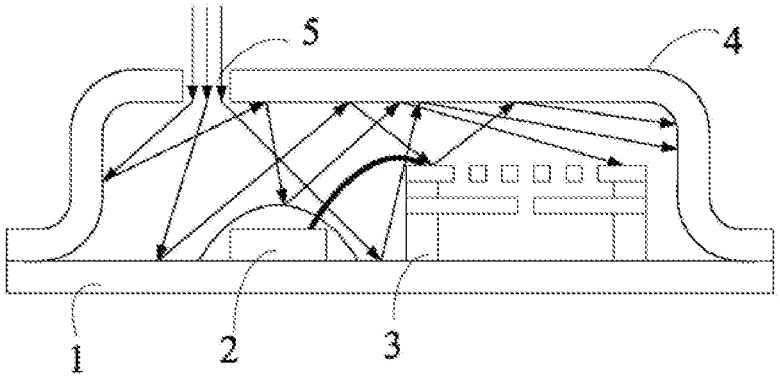
FIG. 1 is a schematic diagram of a package structure of a MEMS microphone in the prior art.
Figure 2:
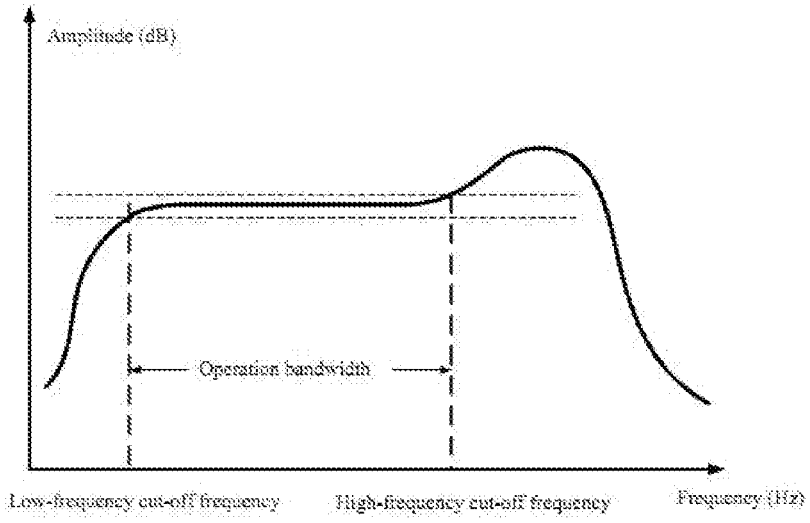
FIG. 2 shows a frequency response curve of the package structure shown in FIG. 1.

Various exemplary embodiments of the present invention will now be described in detail with reference to the drawings. It should be noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the invention, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed for following figures.

Figure 3:
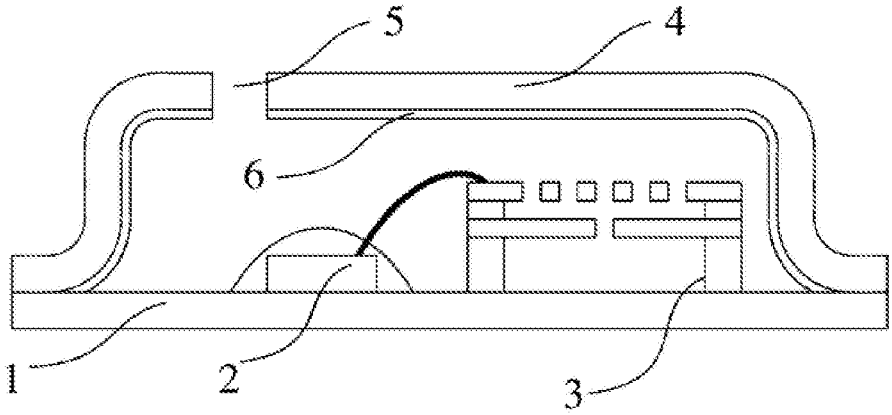
FIG. 3 is a s schematic diagram of a package structure of a MEMS microphone in the present invention.

Referring to FIG. 3, there is a package structure of a MEMS microphone provided by present invention. The package structure comprises a package substrate 1 and a package shell 4 which is mounted with the package substrate 1 to form a closed cavity of a MEMS microphone. The package shell 4 may also be in the form of a flat plate. Here, it is also necessary to provide a side wall portion to support the package shell 4 on the package substrate 1 to form external package of the microphone together. A sound hole 5 allowing sound to flow into the closed cavity is formed on the package shell 4 or the package substrate 1. The package shell 4, the package substrate 1 and the sound hole 5 together constitute a Helmholtz resonant cavity structure.

The package structure provided by the present invention further comprises a MEMS chip 3 and an ASIC chip 2 provided in the Helmholtz resonant cavity. The MEMS chip 3 is a transuding component for converting a sound signal into an electric signal, and is manufactured based on the MEMS process. The ASIC chip 2 is a signal amplifier which is mainly configured to amplify the electric signal output from the MEMS chip 3 for processing easily in subsequent. In the present invention, the MEMS chip 3 and the ASIC chip 2 may be arranged on the package substrate 1. Of course, for those skilled in the art, the MEMS chip and the ASIC chip may also be arranged on the package shell 4, which will not be described in detail herein.

At least part of the inner wall of the Helmholtz resonant cavity is provided with a sound-absorbing layer 6 which may be provided, for example, in a coating manner; or the whole inner wall of the Helmholtz resonant cavity may be coated with the sound-absorbing layer. In order to adjust a coating ratio of the sound absorbing layer 6, the sound-absorbing layer 6 adopting a mesh structure may be selected. The sound-absorbing layer 6 may be made of sound-absorbing material well known to those skilled in the art, such as sound-absorbing cotton, polyimide, etc., or other soft organic materials.

In the package structure provided by the present invention, the sound-absorbing layer is provided on the inner wall of the Helmholtz resonant cavity. The sound-absorbing layer has a certain absorption capacity to high-frequency sound waves, but has a very low absorption to low-frequency sound waves, so it may be equivalent to a "low-pass filter". Through the absorption of the high-frequency sound waves, a high-frequency amplitude value of sound waves can be suppressed, reducing high-frequency response of the Helmholtz resonant cavity. That is, a high-frequency cut-off frequency of the sound waves is improved, widening operation bandwidth of the MEMS microphone.

Figure 4:
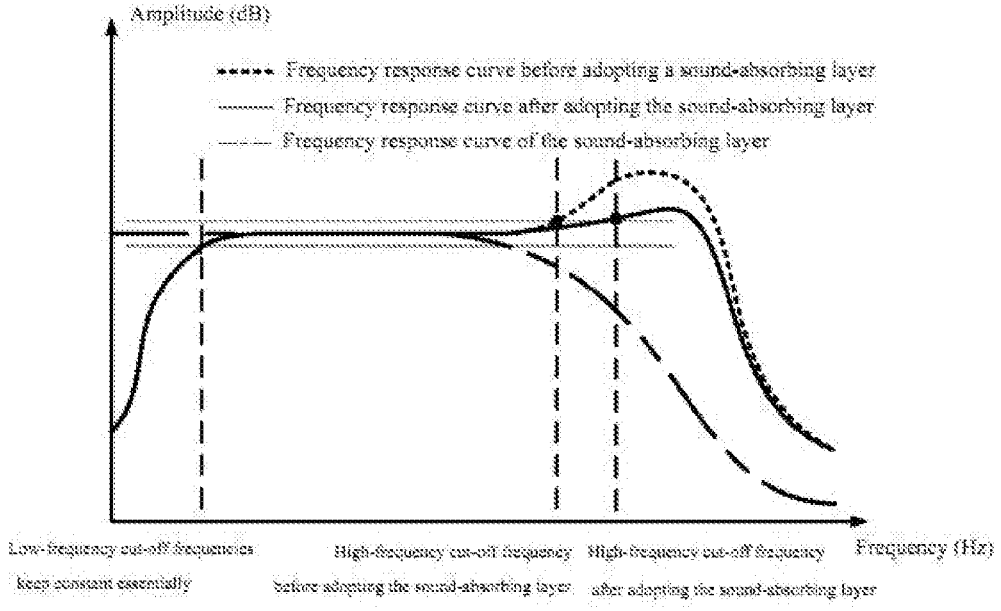
FIG. 4 shows a frequency response curve of the package structure shown in FIG. 3.

FIG. 4 shows a frequency response curve of the package structure provided by the present invention. Before adopting the sound-absorbing layer, a high frequency response peak of the package structure is higher, resulting in a lower high-frequency cut-off frequency and a narrower operation bandwidth of the MEMS microphone. After adopting the sound-absorbing layer, the high-frequency response peak of the MEMS microphone is suppressed, so that the high-frequency cut-off frequency of the MEMS microphone is increased, thereby ultimately widening the operation bandwidth thereof.

In a detailed embodiment of the present invention, the sound-absorbing layer 6 may be provided at any position of the Helmholtz resonant cavity. For example, the sound-absorbing layer may be arranged on the inner wall of the top of the package shell 4, or arranged on the inner wall of the side of the package shell 4, or arranged on the whole inner walls of both the package shell 4 and the package substrate 1. If possible, the sound-absorbing layer 6 may also be arranged on the surface of the ASIC chip 2 in the Helmholtz resonant cavity. On the premise of not excessively destroying the resonance characteristics of the Helmholtz resonant cavity, a high-frequency sound wave absorption rate of the Helmholtz resonant cavity may be adjusted by adjusting the thickness and the coating ratio of the sound-absorbing layer 6, thereby realizing a purpose of adjusting the operation bandwidth of the MEMS microphone.

In order to adjust sound waves before incidence, a sound-permeable layer (not shown in figures) covering the sound hole 5 is further provided at the sound hole 5 of the package shell 4. The sound-permeable layer may be made of material such as a non-woven fabric, and covers the sound hole 5, adjusting a quality factor of the MEMS microphone.

Although some specific embodiments of the present invention have been demonstrated in detail with examples, it should be understood by a person skilled in the art that the above examples are only intended to be illustrative but not to limit the scope of the present invention.

What is claimed is:

1. A package structure of a MEMS microphone, the package structure comprising: a package substrate and a package shell, the package shell being provided on the package substrate and forming a closed cavity with the package substrate, and further comprising a sound hole allowing sound to flow into the closed cavity, wherein the package shell, the package substrate and the sound hole together constitute a Helmholtz resonant cavity with a high resonant frequency, in which a MEMS chip and an ASIC chip are provided; and at least part of an inner wall of the Helmholtz resonant cavity is provided with a sound-absorbing layer configured as a low-pass filter having an absorption capacity to high-frequency sound waves but a very low absorption to low-frequency sound waves, while the thickness of the sound-absorbing layer does not excessively destroy resonance characteristics of the Helmholtz resonant cavity.

2. The package structure according to claim 1, wherein the sound-absorbing layer is provided on the inner wall(s) of the top and/or the side of the package shell.

3. The package structure according to claim 1, wherein the sound-absorbing layer is provided on the inner wall of the package substrate.

4. The package structure according to claim 1, wherein the sound-absorbing layer is of a mesh structure.

5. The package structure according to claim 1, wherein the sound-absorbing layer is provided in a coating manner.

6. The package structure according to claim 1, wherein the sound-absorbing layer is polyimide.

7. The package structure according to claim 1, wherein a sound-permeable layer covering the sound hole is further provided at the sound hole of the package shell.

8. The package structure according to claim 1, wherein the sound-absorbing layer is further provided on the surface of the ASIC chip.

9. The package structure according to claim 1, wherein the MEMS chip and the ASIC chip are provided on the package substrate; and the sound hole is provided on the package shell.

10. The package structure according to claim 1, wherein the package shell is in the form of a flat plate, and the package structure further comprises a side wall portion for supporting the package shell on the package substrate.

11. The package structure according to claim 2, wherein the sound-absorbing layer is of a mesh structure.

12. The package structure according to claim 2, wherein the sound-absorbing layer is provided in a coating manner.

13. The package structure according to claim 2, wherein the sound-absorbing layer is polyimide.

14. The package structure according to claim 2, wherein a sound-permeable layer covering the sound hole is further provided at the sound hole of the package shell.

15. The package structure according to claim 3, wherein the sound-absorbing layer is of a mesh structure.

16. The package structure according to claim 3, wherein the sound-absorbing layer is provided in a coating manner.

17. The package structure according to claim 3, wherein the sound-absorbing layer is polyimide.

18. The package structure according to claim 3, wherein a sound-permeable layer covering the sound hole is further provided at the sound hole of the package shell.

* * * * *